US008863520B2

(12) United States Patent
Bowen et al.

(10) Patent No.: US 8,863,520 B2
(45) Date of Patent: Oct. 21, 2014

(54) METHOD AND APPARATUS FOR AN EXTERNAL COMBUSTION ENGINE HAVING A STEAM GENERATOR

(75) Inventors: Kevin P. Bowen, Bristol, RI (US); Kenneth C. Holmboe, Portsmouth, RI (US); Kurt Stiffel, Warren, RI (US); William E. Komm, Portsmouth, RI (US)

(73) Assignee: Raytheon Company, Waltham, MA (US)

( * ) Notice: Subject to any disclaimer, the term of this patent is extended or adjusted under 35 U.S.C. 154(b) by 217 days.

(21) Appl. No.: 13/553,330

(22) Filed: Jul. 19, 2012

(65) Prior Publication Data

US 2013/0019601 A1 Jan. 24, 2013

Related U.S. Application Data

(60) Provisional application No. 61/509,777, filed on Jul. 20, 2011.

(51) Int. Cl.

| | |
|---|---|
| ***F01K 1/00*** | (2006.01) |
| ***F02P 1/00*** | (2006.01) |
| ***F01K 15/04*** | (2006.01) |
| ***F01K 13/02*** | (2006.01) |
| ***F22B 21/26*** | (2006.01) |

(52) U.S. Cl.

CPC ..... *F01K 13/02* (2013.01); *F01K 15/04* (2013.01); *F01K 15/045* (2013.01); *F22B 21/26* (2013.01)

USPC ..... 60/670; 122/169; 122/247; 60/39.6

(58) Field of Classification Search

USPC ..... 60/670, 39.6; 122/166.1, 166.2, 169, 122/170, 247, 248

See application file for complete search history.

(56) References Cited

U.S. PATENT DOCUMENTS

| | | | | | |
|---|---|---|---|---|---|
| 1,596,797 | A | * | 8/1926 | Briar | 122/182.1 |
| RE23,494 | E | * | 5/1952 | Esnault-Pelterie | 122/169 |
| 3,800,747 | A | * | 4/1974 | Hapgood | 122/235.11 |
| 4,158,438 | A | * | 6/1979 | Hapgood | 237/7 |
| 4,207,842 | A | * | 6/1980 | Kehlhofer | 122/406.4 |
| 7,080,512 | B2 | * | 7/2006 | Schoell | 60/670 |
| 2004/0216460 | A1 | * | 11/2004 | Ruggieri et al. | 60/670 |

FOREIGN PATENT DOCUMENTS

| | | | |
|---|---|---|---|
| EP | 0027055 | * | 4/1981 |

OTHER PUBLICATIONS

"External Combustion Engines for Military Appiications;" Technology Today, Highlighting Raytheon's Technology; 2011, Issue 1: 2 sheets.

* cited by examiner

*Primary Examiner* — Hoang Nguyen

(74) *Attorney, Agent, or Firm* — Daly, Crowley, Mofford & Durkee, LLP

(57) ABSTRACT

Methods and apparatus for a power and/or propulsion system comprising an external combustor, a steam generator, and a radial piston engine. In one embodiment, an undersea vehicle is powered by a propulsion system including a steam generator having a series of coiled tubes in which water is heated to generate steam by combustion of a monopropellant fuel ignited in the external combustor.

18 Claims, 8 Drawing Sheets

METHOD AND APPARATUS FOR AN EXTERNAL COMBUSTION ENGINE HAVING A STEAM GENERATOR

CROSS REFERENCE TO RELATED APPLICATIONS

The present application claims the benefit of U.S. Provisional Application No. 61/509,777, filed on Jul. 20, 2011, which is incorporated herein by reference.

BACKGROUND

As is known in the art, there are a wide variety of engines that combust a material, such as gasoline, and harvest the resultant energy to perform useful work, such as turning a shaft to power a vehicle. External combustion engines, such as steam engines, have used increased pressures and temperatures and heat regeneration to improve performance. Internal combustion engines are well-known to power vehicles, such as automobiles and many other vehicle types.

As is also known, a Rankine cycle is a thermodynamic cycle which converts heat into work using a working fluid, such as water, where the heat is supplied externally via a closed loop. Water is commonly used as the working fluid dues to certain properties including nontoxic and unreactive chemistry, abundance, and low cost, and desirable thermodynamic properties.

SUMMARY

Exemplary embodiments of the invention provide a steam generator coupled to an external combustor fed by a monopropellant fuel that generates hot gases comprising non-polluting byproducts of $CO_2$ an $H_2O$. The steam generator is used to transfer these hot gases through heating tubes to convert the engines deionized water to superheated steam to drive a radial piston engine. An electronic control system controls overall operation of the propulsion engine, fuel, cooling and monitoring systems and electrical energy generation for vehicle/payload power electrical power and/or battery charging.

In an exemplary embodiment, a steam generator comprises a stainless steel cylinder with a flange on either end and multiple sets of concentric spiral tubes surrounding a heat spreading cone with input and output on one end. A combustion chamber supplies hot gases to the steam generator. The steam generator receives water pre-heated by the engine. The combustor supplies heat from combusted monopropellant to the cylinder surrounding the steam tubes for transferring the combustion gases thermal energy to create superheated steam within the tubes. The superheated steam drives the external combustion engine. Exhaust products of carbon dioxide and water exit the steam generator to the condenser/heat recuperator. In exemplary embodiments of the invention, combustion is external and only the fuel and the exhaust are exposed to external pressure.

In one embodiment, the monopropellant fuel, which contains oxygen, is combusted to convert deionized water to high temperature, high pressure steam for driving a radial piston engine. Condensing and cooling the steam from the vapor phase to a liquid releases additional heat that is transferred to the steam tubes for increasing the efficiency of the heat generation system.

With this arrangement, a highly efficient, environmentally friendly, safe method is provided to generate power and propulsion to air-independent systems, such as manned and unmanned undersea vehicles, remotely operated work vehicles, arrays, buoys, charging stations, and undersea facilities. Embodiments of the invention provide high power and energy density exceeding that of known lithium ion batteries, Stirling engines and hydrocarbon/oxygen internal combustion engine solutions.

While exemplary embodiments of the invention are directed to undersea propulsion applications, it is understood that embodiments of the invention are applicable to engines in general in which it is desirable to have air-independent operation.

In one aspect of the invention, a system comprises a steam generator, comprising: a series of coiled tubes each having a respective inlet to receive water and a respective outlet to discharge superheated steam to a radial piston engine, a housing having a first end configured for coupling to a combustor and a second end, the housing containing the coiled tubes, and a cover coupled to the second end of housing and to the tubes, the cover having a series of apertures to allow drainage of water in exhaust generated by a monopropellant fuel ignited in the combustor.

The system can further include one or more of the following features: a heat spreader to promote equal thermal energy transfer among the coiled tubes, the inlets and outlets of the tubes are coupled to the cover, the coiled tubes are coaxially aligned, the inlets of the tubes pass through an inner portion of the heat spreader, the tubes form a part of the closed system for the water and steam, the system comprises an undersea power source, and/or the system comprises an underwater vehicle propulsion and power source.

In another aspect of the invention, a vehicle comprises an external combustion rotary piston engine that is air independent, a combustor coupled to the rotary piston engine and configured to ignite a monopropellant fuel, and a steam generator coupled to the combustor and the rotary piston engine, the steam generator comprising: a series of coiled tubes having a respective inlet to receive water and a respective outlet to discharge superheated steam to drive pistons in the rotary piston engine, a housing having a first end configured for coupling to the combustor and a second end, the housing containing the coiled tubes, and a cover coupled to the second end of housing and to the tubes, the cover having a series of apertures to allow drainage of water from exhaust generated by the monopropellant fuel ignited in the combustor.

The vehicle can further include one or more of the following features: the vehicle comprises an undersea vehicle, the vehicle comprises a robotic vehicle, a muffler to dump carbon dioxide generated by ignited monopropellant fuel from the vehicle, a condenser to receive the water from the exhaust, including a recuperator coupled to the combustor to pre-heat the water flowing into the tubes, a heat spreader to promote equal thermal energy transfer among the coiled tubes, and/or the engine selectively generates from about 3 horsepower to about 330 horsepower.

In a further aspect of the invention, a method comprises: employing a vehicle, comprising: an external combustion rotary piston engine that is air independent, a combustor coupled to the rotary piston engine and configured to ignite a monopropellant fuel, and a steam generator coupled to the combustor and the rotary piston engine, the steam generator comprising: a series of coiled tubes having a respective inlet to receive water and a respective outlet to discharge superheated steam to drive pistons in the rotary piston engine, a housing having a first end configured for coupling to the combustor and a second end, the housing containing the coiled tubes, and a cover coupled to the second end of housing and to the tubes, the cover having a series of apertures to allow drainage of water from exhaust generated by the monopropellant fuel ignited in the combustor. In one embodiment, the vehicle comprises an undersea vehicle.

BRIEF DESCRIPTION OF THE DRAWINGS

The foregoing features of this invention, as well as the invention itself, may be more fully understood from the following description of the drawings in which.

DETAILED DESCRIPTION

Figure 1:
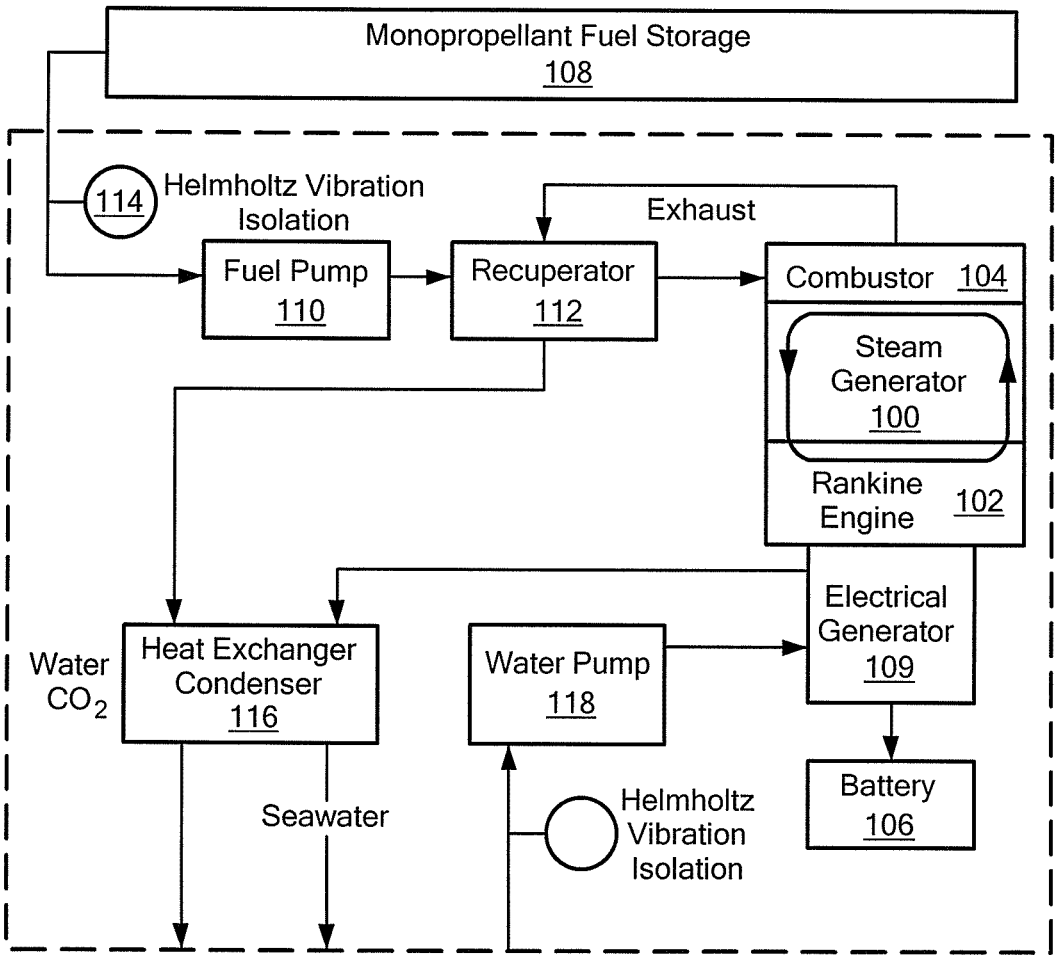
FIG. 1 is a schematic representation of an engine having a steam generator in accordance with exemplary embodiments of the invention.

FIG. 1 shows an exemplary steam generator 100 that forms a part of a system having an external combustion engine 102 in accordance with exemplary embodiments of the invention.

The engine 102 is coupled to a combustor 104 and the steam generator 100. The engine generates power for useful work, such as turning a propulsion/electrical generator shaft 109 and providing energy to a battery 106.

A fuel tank 108 stores fuel for the engine 102 and a fuel pump 110 forces fuel to combustor 104. A dampening mechanism 114, such as a Helmholtz resonator, can be used to reduce noise. The recuperator 112, which pre-heats the fuel, is coupled to the combustor 104, which combusts the fuel. In an exemplary embodiment, the combustor 104 comprises first and second stages that operate in combination with the steam generator, as described more fully below. Exhaust from the combustor 104 goes to the recuperator 112, which is coupled to a condenser 116. The condenser 116 receives the water and carbon dioxide exhaust from the recuperator 112. A pump 118, which can pump seawater for example, is coupled to the steam generator 100, engine 102 and electrical generator 109 which sends the heated seawater to the condenser 116.

In one embodiment, a monopropellant fuel containing oxygen is used. By using a monopropellant fuel, an air-independent system is provided since the fuel provides oxygen instead of air or other source. It is understood that monopropellant fueled engines are well-suited for undersea vehicles or other applications in which oxygen is not readily available for combustion. In one particular embodiment, the ignited monopropellant fuel generates exhaust in the form of water and carbon dioxide. This water can be retained to maintain neutral buoyancy, or removed from a vehicle.

Figure 2:
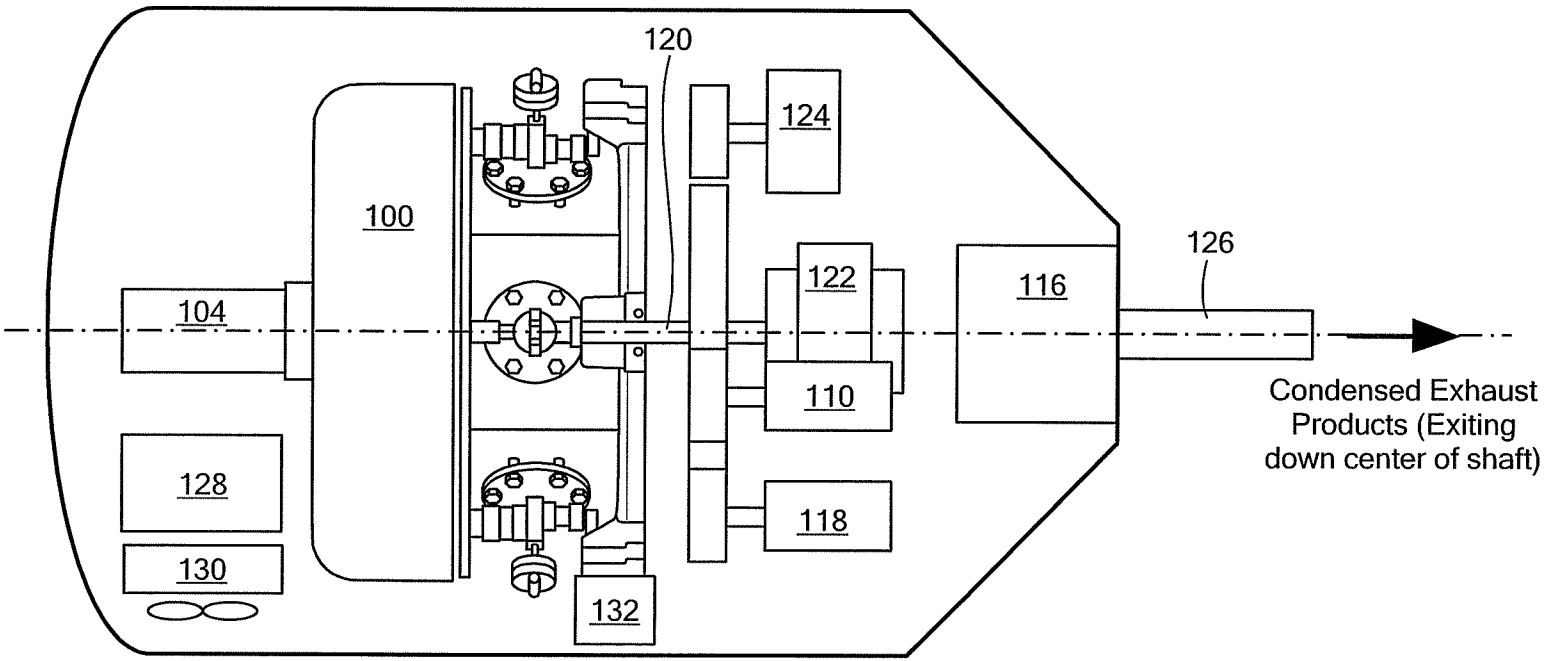
FIG. 2 is a schematic representation of the engine of FIG. 1 showing further mechanical detail.

FIG. 2 shows additional mechanical detail for the engine 102 of FIG. 1. The engine 102 turns a shaft 120 coupled to a gearbox 122. The shaft 120 is also coupled to a DC generator 124.

In the illustrated embodiment, condensed exhaust products exit via the shaft 126 extending from the gearbox 122 through the condenser and isolated shaft bearing 116.

Figure 3:
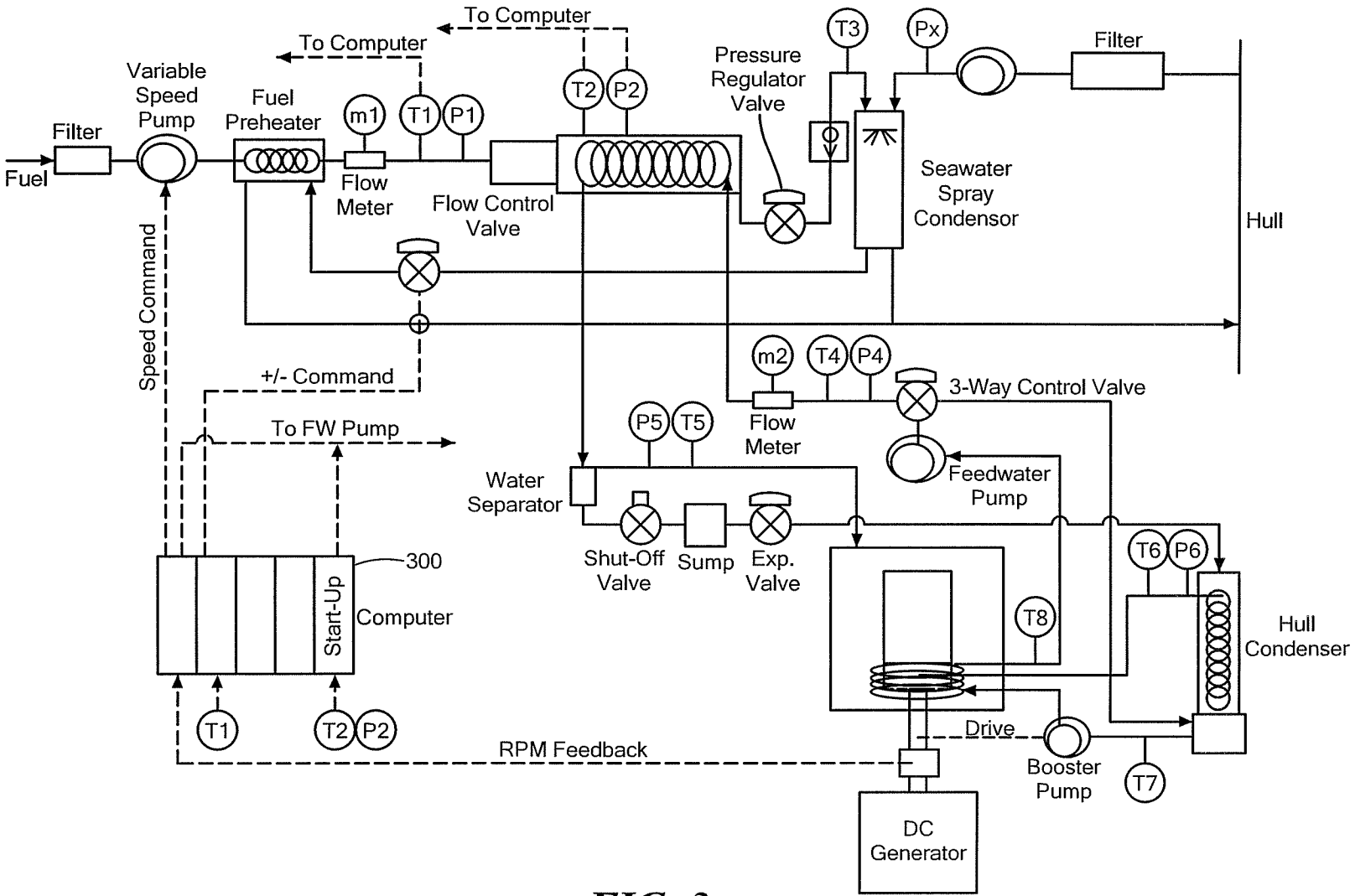
FIG. 3 is a schematic of an exemplary power system implementation.

FIG. 3 shows further detail of an exemplary implementation to control overall operation of the system. A controller 300 receives information from pressure sensors P1-P5, temperature sensors T1-T8, and flow rate monitors m1, m2. Based on the sensor information and the desired engine operation, e.g., power, torque, and RPM, the controller 300 controls the fuel flow, pressure, and pre-heating characteristics by adjusting the band heaters, glow plugs, injectors, and fuel flow pressure. The controller 300 also controls the water supply pressure and lubricating pumps, and cooling system water flow rates via pressure, temperature, and flow rate.

Figure 4:
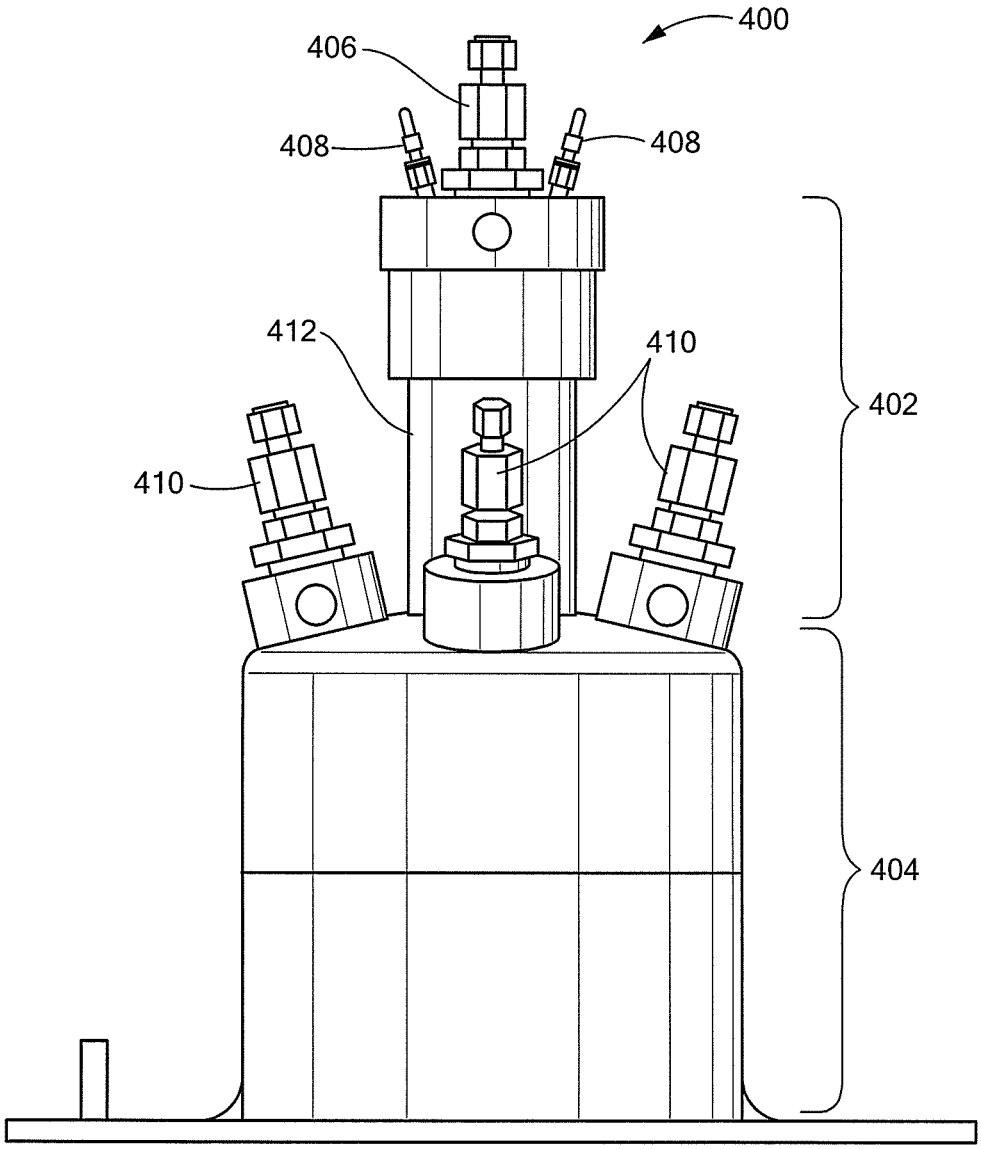
FIG. 4 is a schematic representation of a combustor.
Figure 4A:
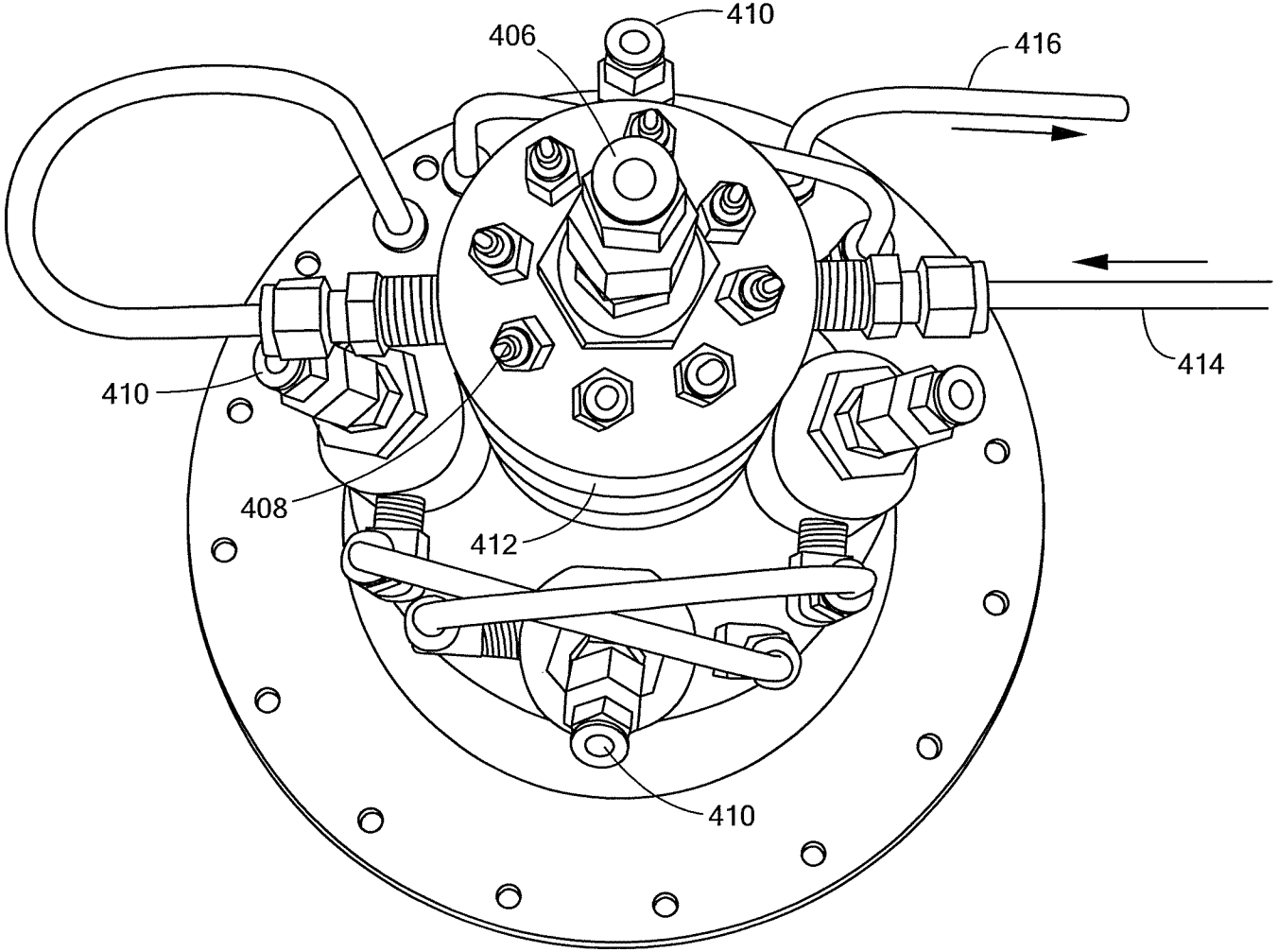
FIG. 4A is a mechanical depiction of the combustor of FIG. 4.

FIGS. 4 and 4A show an exemplary embodiment of a combustor 400 having first and second chambers 402, 404 to combust the monopropellant fuel. A first fuel nozzle 406 is coupled to the first chamber 402, which can comprise a cylinder. A series of glow plugs 408, or other suitable devices, are installed about a top of the first chamber 402 to heat the fuel. Further fuel nozzles 410 are connected to the second chamber 404. A heater 412 also heats fuel in the first chamber 402. The fuel is ignited in the first chamber by the glow plugs 408 and the band heater 412. The exhaust from the first chamber 402 enters the second chamber 404 and heats the second chamber to a temperature that is sufficient to ignite the fuel, if any, in the second chamber. As described more fully below, the steam generator uses the exhaust from the second chamber 404 to generate the superheated steam to drive pistons in a rotary engine. The combustor 400 also includes a fluid, e.g., water, inlet 414 and a fluid outlet 416.

It is understood that the fuel flow rate into the first and second chambers 402, 404 is determined by the pump pressure. The heat from the first chamber 402 feeds the second chamber 404. The nozzles into the first and second chambers control the engine power over the full range of engine operation, e.g., power, torque, and revolutions per minute (RPM). At minimum speed, no fuel may be pumped into the second chamber. As more speed is desired, additional nozzles can be actuated to allow more fuel to enter the second chamber.

Figure 5:
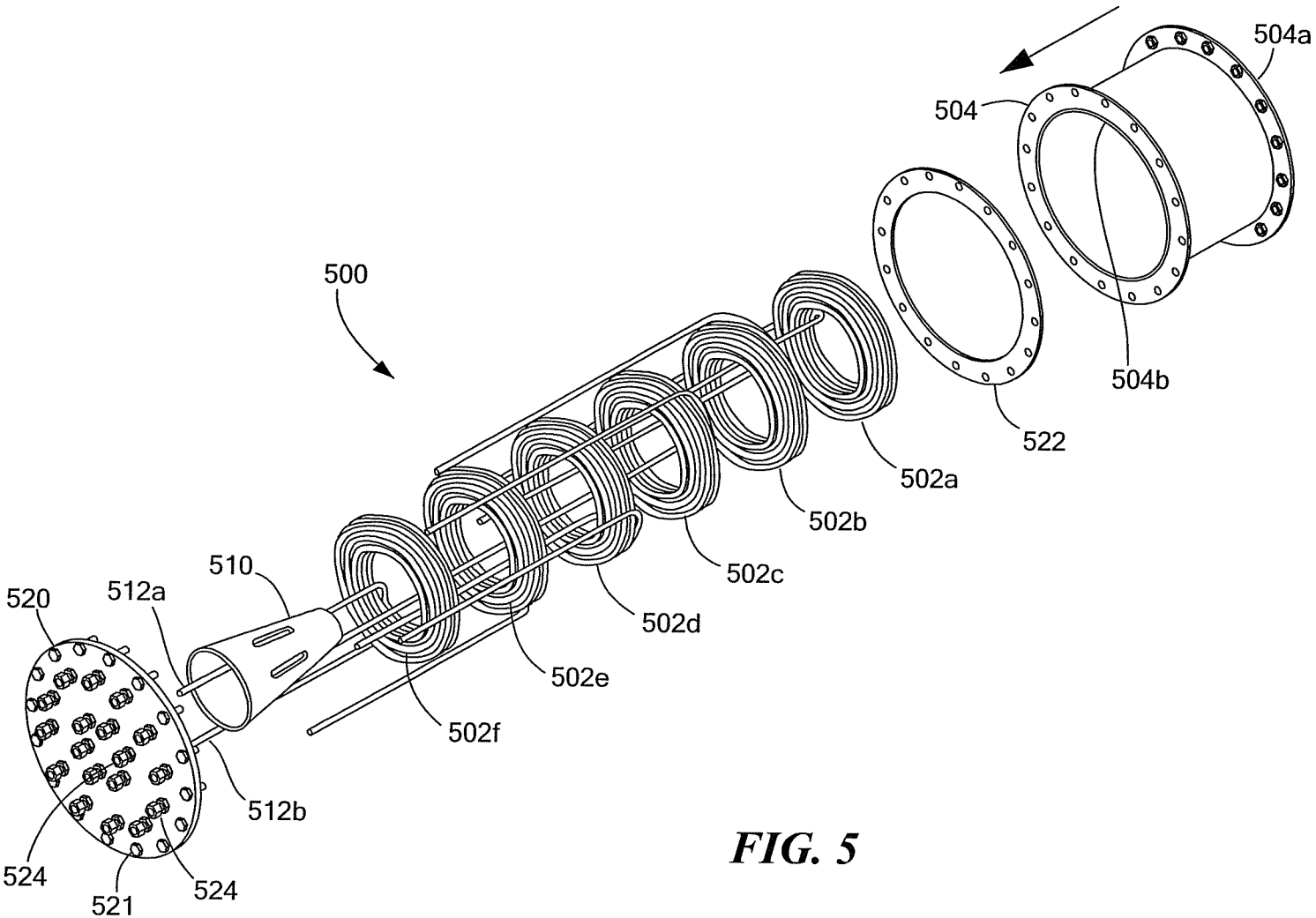
FIG. 5 is an exploded view of a steam generator.

FIG. 5 shows an exemplary embodiment in exploded form of a steam generator 500 for coupling to the combustor. In one embodiment, the steam generator 500 includes a series of coiled tubes 502*a-f* containing deionized water, or other suitable fluid, that is heated to steam by thermal energy from ignited fuel exiting the combustor. The tubes 502 are disposed within a housing 504, which can comprise a steel cylinder. An end 504*a* of the housing can be coupled to the combustor (not shown) to receive the fuel exhaust containing water and carbon dioxide.

In an exemplary embodiment, the steam generator 500 includes a heat spreader mechanism 510 that promotes distribution of heat from the combustor evenly among the tubes 502. In one embodiment, the heat spreader mechanism 510 is generally cone-shaped and formed from 321 stainless steel. The heat from the combustor enters the distal end of the steam generator outside of the heat spreader 510 and inside the diameter of the coiled tubes 502. It is understood that the heat spreader 510 can be any shape that effectively distributes the heat energy to the tubes 502 and any material that has desired thermal conductivity characteristics.

Each of the coiled tubes 502, such as tube 502*f*, has an inlet 512*a* and an outlet 512*b* coupled to an end of the steam generator. Water flows into the inlet 512*a*, turns to superheated steam, and exits via the outlet 512*b*. In one embodiment, the water is pre-heated by the engine/recuperator. The steam discharged from the outlet 512*b* goes to the radial engine to power pistons that rotate the engine drive shaft, and subsequently flows to the cooling condenser. The condenser/reservoir collects the water to be pumped back into the engine pre-heater. The high pressure pump on the engine supplies this pre-heated water to the steam generator to be turned into superheated steam, and so on.

In one embodiment a cover 520 is secured to a second end 504*b* of the housing by a gasket 522. The cover 520 includes a series of couplings 524 for the tube inlets 512*a*, and outlets 512*b*. In an alternative embodiment, apertures can be used instead of coupling to enable the tubes to pass through the cover. The cover 520 also includes a drain hole 521 that enables water generated as exhaust from the monopropellant fuel ignited in the combustor to drain from the housing 504.

Figure 6:
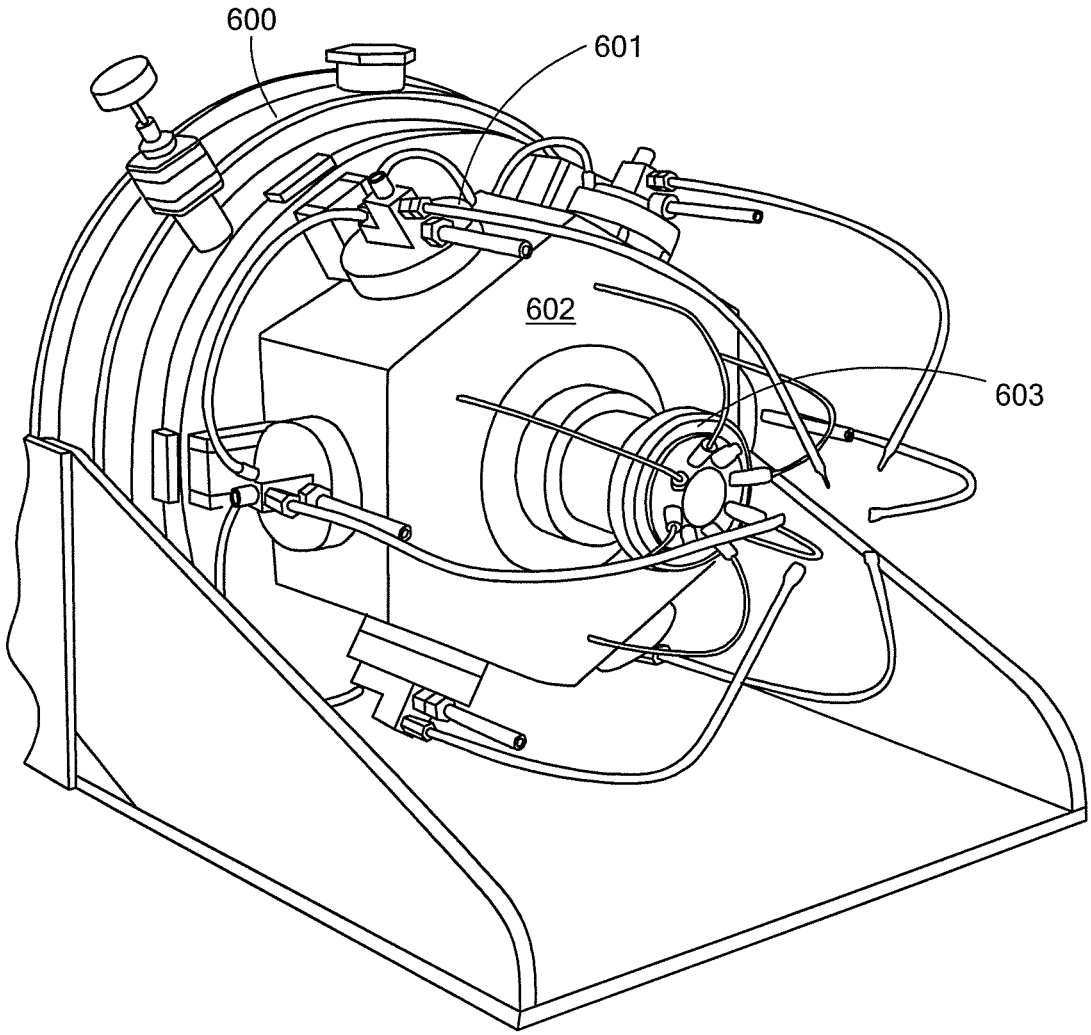
FIG. 6 is a schematic representation of a portion of a radial piston engine having pistons powered by a steam from a steam generator.

FIG. 6 shows a portion of an exemplary radial piston engine 600 that can be powered by a steam generator in accordance with exemplary embodiments of the invention. Water is pre-heated in the radial piston portion of the engine 601 and fed to the high pressure pump 602. This pre-heated water is pumped to the steam generator to be turned into super-heated steam. The super-heated steam returns from the steam generator to drive the radial pistons 603 to turn the engine shaft.

Figure 7:
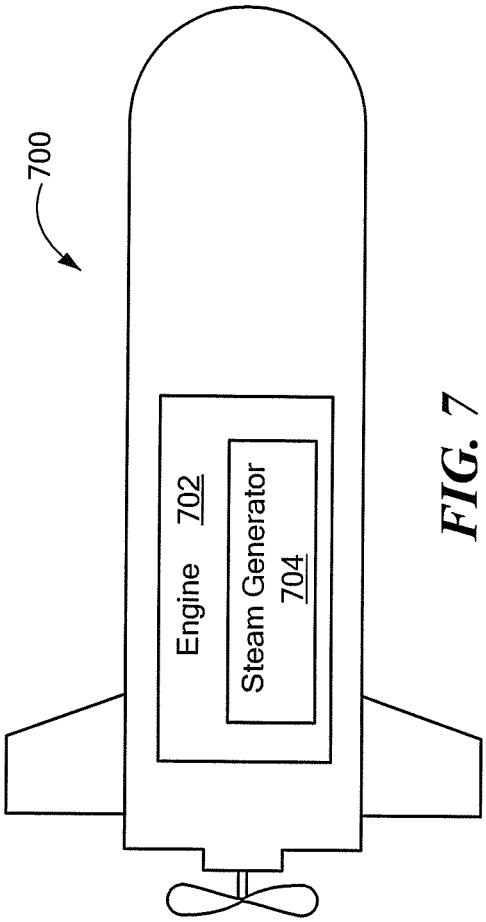
FIG. 7 is a schematic representation of an exemplary vehicle including an external combustion engine having a steam generator in accordance with exemplary embodiments of the invention.

FIG. 7 shows an exemplary vehicle 700 including an external combustion engine 702 having a steam generator 704 in accordance with exemplary embodiments of the invention. In one embodiment, the vehicle is an air independent underwater vehicle, such as a remotely operated vehicle, using a monopropellant fuel powering a rotary engine.

Figure 7A:
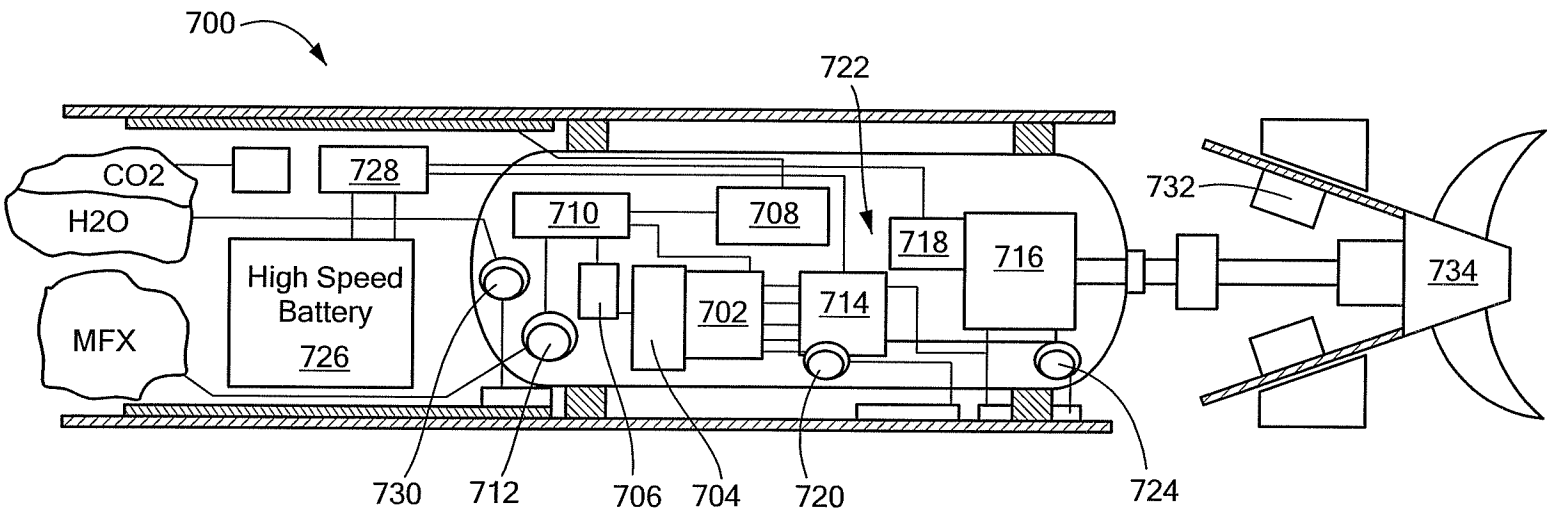
FIG. 7A is an exemplary implementation of the vehicle of FIG. 7.

FIG. 7A shows an exemplary implementation of the vehicle of FIG. 7 including a radial piston engine 702 coupled to a steam generator 704 and an external combustor 706. A recuperator 708 is coupled to an acoustic muffler 710, which is coupled to a fuel pump 712. The engine 702 is coupled to an alternator 714, which is coupled to an electric motor 716 controlled by a controller 718. An oil pump 720 can be coupled to the alternator 714. Exhaust gas pipes 722 are located proximate the engine/generator. A coolant pump 724 can be coupled to the alternator 714 and electric motor 716. A battery 726 is controlled by battery electronics 728. A condensate pump 730 can facilitate the removal of internal condensate. For undersea control of the vehicle, fin actuators 732 can be located proximate a propulsor 734.

In one embodiment, deionized water is used for steam generation as part of a closed cycle, radial piston engine. This system uses superheated steam from an external combustor to generate superheated steam via transfer of heat through steam tubes in the steam generator. In exemplary embodiments, a monopropellant fuel is used that produces water and carbon dioxide as exhaust products. In one particular embodiment, monopropellant fuel designated Moden X from James R. Moden, Inc., of Richmond, R.I., is used. Other suitable fuels, such as isopropyl alcohol, hydrogen peroxide and water in safe proportions known to one of ordinary skill in the art can be used.

In one embodiment, a 5" diameter, 10" long,12 pound combustor combined with a 12" diameter, 16" long 25 pound steam generator powers a 22" diameter, 28" long 100 pound 36 hp radial piston engine. Two 4" diameter, 12" long 10 pound condensers are used to cool and store the deionized water working fluid. There is approximately 1 pound of water flow per hp output.

It is understood that in other embodiments components can have larger and smaller dimensions to meet the needs of a particular application.

In an exemplary embodiment, the superheated steam from the steam generator is discharged at about 1100 degrees F. and about 2000 psi. Water is preheated by the engine to about 180 degrees F.

It is understood that the exemplary engine/steam generator is applicable to a wide range of applications including undersea propulsion, manned and unmanned vehicles, remotely operated submersibles, power generation for buoys, arrays, sonar systems, torpedoes, quiet power generators, forward operating bases, surveillance systems, exoskeletons, biometric power assist, high altitude aircraft, solar/wind power generation, space, etc.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A system, comprising:

a steam generator, comprising:

a series of coiled tubes each having a respective inlet to receive water and a respective outlet to discharge superheated steam to a radial piston engine;

a housing having a first end configured for coupling to a combustor and a second end, the housing containing the coiled tubes; and a cover coupled to the second end of housing and to the tubes, the cover having a series of apertures to allow drainage of water in exhaust generated by a monopropellant fuel ignited in the combustor.

2. The system according to claim 1, further including a heat spreader to promote equal thermal energy transfer among the coiled tubes.

3. The system according to claim 1, wherein the inlets and outlets of the tubes are coupled to the cover.

4. The system according to claim 1, wherein the coiled tubes are coaxially aligned.

5. The system according to claim 1, wherein the inlets of the tubes pass through an inner portion of the heat spreader.

6. The system according to claim 1, wherein the tubes form a part of the closed system for the water and steam.

7. The system according to claim 1, wherein the system comprises an undersea power source.

8. The system according to claim 1, wherein the system comprises an underwater vehicle propulsion and power source.

9. A vehicle, comprising:

an external combustion rotary piston engine that is air independent;

a combustor coupled to the rotary piston engine and configured to ignite a monopropellant fuel; and a steam generator coupled to the combustor and the rotary piston engine, the steam generator comprising:

a series of coiled tubes having a respective inlet to receive water and a respective outlet to discharge superheated steam to drive pistons in the rotary piston engine;

a housing having a first end configured for coupling to the combustor and a second end, the housing containing the coiled tubes; and a cover coupled to the second end of housing and to the tubes, the cover having a series of apertures to allow drainage of water from exhaust generated by the monopropellant fuel ignited in the combustor.

10. The vehicle according to claim 9, wherein the vehicle comprises an undersea vehicle.

11. The vehicle, according to claim 9, wherein the vehicle comprises a robotic vehicle.

12. The vehicle according to claim 9, further including a muffler to dump carbon dioxide generated by ignited monopropellant fuel from the vehicle.

13. The vehicle according to claim 9, further including a condenser to receive the water from the exhaust.

14. The vehicle according to claim 9, further including a recuperator coupled to the combustor to pre-heat the water flowing into the tubes.

15. The vehicle according to claim 9, further including a heat spreader to promote equal thermal energy transfer among the coiled tubes.

16. The vehicle according to claim 9, wherein the engine selectively generates from about 3 horsepower to about 330 horsepower.

17. A method, comprising:

employing a vehicle, comprising:

an external combustion rotary piston engine that is air independent;

a combustor coupled to the rotary piston engine and configured to ignite a monopropellant fuel; and a steam generator coupled to the combustor and the rotary piston engine, the steam generator comprising:

a series of coiled tubes having a respective inlet to receive water and a respective outlet to discharge superheated steam to drive pistons in the rotary piston engine;

a housing having a first end configured for coupling to the combustor and a second end, the housing containing the coiled tubes; and a cover coupled to the second end of housing and to the tubes, the cover having a series of apertures to allow drainage of water from exhaust generated by the monopropellant fuel ignited in the combustor.

18. The method according to claim 17, wherein the vehicle comprises an undersea vehicle.

* * * * *